US009518312B2

(12) United States Patent
Yamaura et al.

(10) Patent No.: US 9,518,312 B2
(45) Date of Patent: Dec. 13, 2016

(54) AL—MG—SI-BASED, CASTING ALUMINUM ALLOY WITH EXCELLENT YIELD STRENGTH AND CAST MEMBER MADE THEREOF

(75) Inventors: Hideki Yamaura, Moka (JP); Hidetsuna Watanabe, Moka (JP)

(73) Assignee: HITACHI METALS, LTD., Tokyo (JP)

( * ) Notice: Subject to any disclaimer, the term of this patent is extended or adjusted under 35 U.S.C. 154(b) by 1152 days.

(21) Appl. No.: 13/260,468

(22) PCT Filed: Mar. 31, 2010

(86) PCT No.: PCT/JP2010/055940

§ 371 (c)(1),
(2), (4) Date: Oct. 7, 2011

(87) PCT Pub. No.: WO2010/114063

PCT Pub. Date: Oct. 7, 2010

(65) Prior Publication Data

US 2012/0034128 A1 Feb. 9, 2012

(30) Foreign Application Priority Data

Mar. 31, 2009 (JP) ..... 2009-088375
Sep. 30, 2009 (JP) ..... 2009-229017

(51) Int. Cl.

| | |
|---|---|
| ***C22C 21/06*** | (2006.01) |
| ***C22C 21/08*** | (2006.01) |
| ***C22C 21/02*** | (2006.01) |

(52) U.S. Cl.
CPC ..... *C22C 21/08* (2013.01); *C22C 21/02* (2013.01); *C22C 21/06* (2013.01)

(58) Field of Classification Search
CPC ..... C22C 21/06; C22C 21/08
See application file for complete search history.

(56) References Cited

U.S. PATENT DOCUMENTS

| | | | |
|---|---|---|---|
| 2002/0088512 | A1 | 7/2002 | Kitaoka et al. |
| 2008/0233000 | A1 | 9/2008 | Yano |

FOREIGN PATENT DOCUMENTS

| | | | | |
|---|---|---|---|---|
| JP | 62-222039 | A | | 9/1987 |
| JP | 5-163546 | A | | 6/1993 |
| JP | 05163546 | A | * | 6/1993 |
| JP | 9-249931 | A | | 9/1997 |
| JP | 9-279279 | A | | 10/1997 |
| JP | 2002-206133 | A | | 7/2002 |
| JP | 2003-147470 | A | | 5/2003 |
| JP | 2008-231565 | A | | 10/2008 |

OTHER PUBLICATIONS

'Aluminum and Aluminum Alloys', ASM International, 1993, p. 22, 45.*

Davis, J. R. 'Aluminum and Aluminum Alloys', ASM International, 1993, p. 22, 23, 43, 89-91.*

* cited by examiner

*Primary Examiner* — Roy King
*Assistant Examiner* — Janelle Morillo
(74) *Attorney, Agent, or Firm* — Sughrue Mion, PLLC

(57) ABSTRACT

A Al—Mg—Si-based, casting aluminum alloy comprising by mass 4-6% of Mg, 3.1-4.5% of Si, 0.5-1% of Mn, 0.1-0.3% of Cr, and 0.1-0.4% of Cu, the balance being Al and inevitable impurities.

10 Claims, No Drawings

AL—MG—SI-BASED, CASTING ALUMINUM ALLOY WITH EXCELLENT YIELD STRENGTH AND CAST MEMBER MADE THEREOF

CROSS REFERENCE TO RELATED APPLICATIONS

This application is a National Stage of International Application No. PCT/JP2010/055940, filed on Mar. 31, 2010, which claims priority to Japanese Patent Application Nos. 2009-088375, filed on Mar. 31, 2009 and 2009-229017, filed on Sep. 30, 2009, the entire contents of which are incorporated by reference herein.

FIELD OF THE INVENTION

The present invention relates to an Al—Mg—Si-based, casting aluminum alloy with excellent yield strength, and a cast member made thereof.

BACKGROUND OF THE INVENTION

Cast members of aluminum alloys advantageous in weight reduction, easy working to complicated shapes, production cost reduction, etc. are widely used for various parts. Particularly energy reduction and the improvement of fuel efficiency are required for automobiles, etc., and cast members of aluminum alloys constituting them are desired to have further reduced weight and higher quality. To have mechanical properties generally required for parts constituting vehicles, etc., casting aluminum alloys are required to have yield strength of about 200 MPa or more and elongation of about 3% or more, and particularly parts constituting automobile bodies, etc., which should have strength enough resistant to plastic deformation even when made thinner, are required to have yield strength of about 220 MPa or more.

It is known that the yield strength of metal materials such as aluminum alloys, etc. increases as their crystal grains become smaller. One of factors affecting the crystal grain sizes is a solidification rate; a higher solidification rate provides smaller crystal grains and a higher yield strength. To increase the solidification rate for a higher yield strength, it may be considered to make cast members thinner, and use a high-pressure die-casting method whose rate is higher than those of a low-pressure die-casting method and a gravity die-casting method. However, because the resultant castings have non-uniform shapes and sizes as well as casting defects, etc., the improvement of a yield strength only by increasing the solidification rate is limited.

Casting aluminum alloys include hypoeutectic Al—Si aluminum alloys such as JIS ADC12, AC4B, etc. However, the ADC12 alloy has as low yield strength as about 150 MPa in an as-cast state despite excellent castability, and the AC4B alloy needs a heat treatment after casting to have a yield strength of about 200 MPa. However, heat treatment increases a production cost because it increases the number of steps and energy consumption, and likely provides thin, complicated or large castings with deformation and strain, further increasing the cost to remove them.

Hyper-eutectic Al—Si alloys such as JIS ADC14 having a high yield strength without heat treatment are also known. Though this alloy has a yield strength of about 250 MPa in an as-cast state, ductility-decreasing, hard, brittle Si particles are easily crystallized because of the high Si content, so that it has extremely low elongation of less than about 1%, resulting in the limited applications of its cast members.

Because the elongation of less than about 1% provides insufficient ductility, cast members are easily cracked and broken by impact when dropped.

Recently becoming used as casting aluminum alloys different from the Al—Si aluminum alloys to meet the requirement of higher quality are Al—Mg aluminum alloys such as JIS ADC5, ADC6, AC7A, etc. Though these aluminum alloys have excellent ductility without heat treatment, they have insufficient strength. For example, the ADC5 alloy has as low yield strength as about 190 MPa. In addition, the Al—Mg aluminum alloys are poorer than the Al—Si aluminum alloys in castability such as poorer melt flow, more misrun, larger solidification shrinkage, more shrinkage cavities, more cracks (hot cracks) on the surface, etc. In other words, the Al—Mg aluminum alloys do not have yield strength making up for cost increase for increasing castability.

As an attempt to improve the castability of Al—Mg aluminum alloys, JP 5-163546 A proposes a high-pressure die-casting aluminum alloy comprising 3.5-8.5% by weight of Mg, 1.5-4.0% by weight of Si, 0.3-1.0% by weight of Fe and 0.2-0.6% by weight of Mn, the balance being Al and inevitable impurities. Mg and Si synergistically contribute to increasing the strength and castability, preventing hot cracking. JP 5-163546 A describes that this aluminum alloy may contain Cr, Cu, Ti, Zr and Zn as impurities.

However, JP 5-163546 A fails to refer to yield strength and elongation, though it describes the hot cracking ratio, thermal expansion coefficient and tensile strength of the alloy. Presumption referring to the tensile strength, a typical mechanical property, reveals that the Al—Mg aluminum alloy of JP 5-163546 A has insufficient yield strength of about 180 MPa. Thus, conventional, Al—Si-based, or Al—Mg-based, casting aluminum alloys do not have sufficient elongation and yield strength in an as-cast state.

OBJECT OF THE INVENTION

Accordingly, an object of the present invention is to provide an Al—Mg—Si-based, casting aluminum alloy having sufficient elongation and high yield strength even in an as-cast state, making it possible to achieve the weight reduction of vehicles, etc., and a cast member made of such an aluminum alloy.

DISCLOSURE OF THE INVENTION

As a result of investigating the mechanical properties of high-pressure die-cast Al—Mg—Si aluminum alloys having various compositions in as-casts state in view of the above object, the inventors have found that the optimization of the amounts of Mg, Si and Mn added together with proper amounts of Cr and Cu provides an Al—Mg—Si aluminum alloy with improved yield strength and elongation due to the co-existence of Cr and Cu in the alloy structure. The present invention has been completed based on such finding.

Thus, the Al—Mg—Si-based, casting aluminum alloy of the present invention with excellent yield strength comprises by mass 4-6% of Mg, 3.1-4.5% of Si, 0.5-1% of Mn, 0.1-0.3% of Cr, and 0.1-0.4% of Cu, the balance being Al and inevitable impurities.

The Al—Mg—Si-based, casting aluminum alloy of the present invention may further comprise 0.05-0.3% by mass of Ti.

The cast member of the present invention is made of the above Al—Mg—Si aluminum alloy.

DESCRIPTION OF THE BEST MODE OF THE INVENTION

[1] Al—Mg—Si-based, Casting Aluminum Alloy

The Al—Mg—Si aluminum alloy of the present invention will be explained in detail below. The amount of each alloy element is expressed by "% by mass," unless otherwise mentioned.

(1) Mg: 4-6%

Mg is dissolved in the matrix of the Al—Mg—Si aluminum alloy to form a solid solution, improving its yield strength. Mg also forms $Mg_2Si$ with Si. Particularly in a composition in which a weight ratio of Mg to Si is $0.92<Mg/Si<1.93$, eutectic $Mg_2Si$ is crystallized in crystal grain boundaries, suppressing hot cracking. The Mg content of less than 4.0% does not improve the yield strength sufficiently, and the Mg content of more than 6.0% deteriorates balance with the Si content, failing to suppress hot cracking sufficiently. Accordingly, the Mg content is 4-6%, preferably 4.5-6%, more preferably 5-6%.

(2) Si: 3.1-4.5%

Si is dissolved in the matrix of the aluminum alloy to form a solid solution, contributing to the improvement of yield strength. It also prevents hot cracking with Mg. Less than 3.1% of Si does not improve the yield strength sufficiently, and more than 4.5% of Si has poor balance with the Mg content, failing to prevent hot cracking sufficiently, and drastically reducing ductility. Accordingly, the Si content is 3.1-4.5%, preferably 3.5-4.3%.

(3) Mn: 0.5-1%

Mn is dissolved in the aluminum alloy matrix to form a solid solution to improve strength, and crystallize bulky Al—Mn intermetallic compounds, thereby preventing a melt from sticking to a molding die. When Mn is less than 0.5%, these effects are small. When it exceeds 1%, needle-shaped Al—Mn intermetallic compounds are crystallized, resulting in low ductility. Accordingly, the Mn content is 0.5-1%, preferably 0.7-0.9%.

(4) Cr: 0.1-0.3%

Cr is dissolved in the matrix to form a solid solution, improving the yield strength without reducing ductility, by co-existence with Cu. When Cr is less than 0.1%, its effect is insufficient, and when Cr is more than 0.3%, coarse Al—Mn—Si—Cr compounds are crystallized, reducing the ductility and failing to stably have enough elongation. Accordingly, the Cr content is 0.1-0.3%, preferably 0.2-0.3%.

(5) Cu: 0.1-0.4%

Cu is dissolved in the matrix to form a solid solution like Cr, improving the yield strength. A larger yield-strength-improving effect is obtained by the addition of both Cu and Cr than by the addition of Cu only. Such effect is insufficient when Cu is less than 0.1%. Cu is dissolved in primary crystals in an amount of up to 0.4% to form a solid solution, improving the yield strength, but when it exceeds 0.4%, Cu is less dissolved in primary crystals in an as-cast state, failing to improve the yield strength, and reducing corrosion resistance. Accordingly, the Cu content is 0.1-0.4%, preferably 0.2-0.35%.

As described above, the casting aluminum alloy of the present invention containing both Cr and Cu has drastically improved yield strength without suffering elongation reduction even in an as-cast state. Both of Cr and Cu provide the solid solution strengthening of the matrix, though such improvement of the yield strength cannot be expected by adding Cr or Cu alone. When only Cr is added, excess Cr is crystallized as coarse Al—Mn—Si—Cr compounds in grain boundaries, failing to improve the yield strength of the aluminum alloy, and extremely lowering the ductility. When only Cu is added, Cu is concentrated and segregated in the alloy liquid phase during solidification, forming Cu-concentrated portions in the grain boundaries of primary crystals, failing to improve the yield strength. However, the detailed observation of the solidified structure of an alloy containing both Cr and Cu has revealed that both Cr and Cu coexist with Al, Si and Mg in the same portions, resulting in a smaller amount of Al—Mn—Si—Cr compounds formed by the existence of Cr, and smaller fractions of Cu-concentrated portions formed by the existence of Cu in primary crystal grain boundaries. The reason therefore is not necessarily clear, but it may be presumed from the form of Cr and Cu that both Cr and Cu contained in primary crystals improve the yield strength effectively without increasing Cr-containing intermetallic compounds and the segregation of Cu, which reduce the elongation. The total amount of Cr and Cu is preferably 0.2-0.7%, more preferably 0.3-0.65%, most preferably 0.4-0.6%.

(6) Ti: 0.05-0.3%

Ti makes crystal grains finer, improving the strength and ductility of the aluminum alloy, and preventing hot cracking against stress generated by the solidification shrinkage of the alloy melt. To exert these functions effectively, Ti is preferably 0.05% or more. Because Ti contained in a high-purity Al ingot as an inevitable impurity is less than 0.05%, Ti should be added positively to obtain the above effects while using the high-purity Al ingot. However, when low-purity Al ingots, for instance, aluminum alloy scraps of wrought aluminum alloys such as 5000 Alloy, ADC12 Alloy, etc. are used as starting materials, 0.05% or more of Ti is usually contained as an inevitable impurity. However, when Ti is more than 0.3%, Al—Ti intermetallic compounds are crystallized, rather providing the aluminum alloys with low ductility. Accordingly, Ti, if added, is 0.05-0.3%, preferably 0.1-0.2%. Of course, even when Ti is not added positively, Ti in a smaller amount than the above lower limit may be contained as an impurity.

[2] Cast Member

The cast member of the present invention can be produced by casting methods using a die such as a gravity casting method, a low-pressure casting method, a high-pressure casting method, etc. Among them, the use of a high-pressure die-casting method, one of high-pressure casting methods, provides a dense cast structure having fine crystal grains by rapid solidification, thereby producing cast members having improved strength and ductility due to compression stress on the surface. Because a melt can be surely filled in thin portions by the high-pressure die-casting method, cast members with good dimensional accuracy and beautiful as-cast surfaces can be obtained at a high production yield with reduced production cycles. Further, the use of a vacuum die-casting method can prevent the generation of voids by entrained air or gas, and provides a smooth melt flow, reducing misrun such as cold shut, etc. The vacuum die-casting method is suitable for obtaining cast members having excellent mechanical properties, particularly high yield strength.

Cast members made of the Al—Mg—Si aluminum alloy of the present invention have large elongation and high yield strength without a heat treatment after casting. For instance, high-pressure die-cast members made of the Al—Mg—Si aluminum alloy of the present invention have an average DAS (dendrite arm spacing) of 7 μm, elongation of 3% or more, and yield strength of 220 MPa or more in an as-cast state. The average DAS is a parameter representing a crystal grain size. When high strength and ductility are needed, the cast members may be subject to a heat treatment such as a solution treatment, an aging treatment, etc., after casting.

Thus, the cast members of the present invention having good elongation as well as excellent yield strength are suitable for cast parts for constituting vehicles, etc. needing high mechanical properties, for example, chassis members for automobiles and motorcycles, power train parts, space frames, frames for steering wheels, seat frames, suspension members, engine blocks, cylinder head covers, chain cases, transmission cases, oil pans, pulleys, shift levers, instrument panels, air intake surge tanks, pedal brackets, etc.

The present invention will be explained in more detail referring to Examples below without intention of restricting it thereto.

EXAMPLES 1-22, AND COMPARATIVE EXAMPLES 1-41

Tables 1-1 and 1-2 show the compositions of the aluminum alloys of Examples 1-22 and Comparative Example 1-41 (other alloy elements than shown in Table are substantially Al and inevitable impurities), and the mechanical properties of their die-cast products. The alloys of Comparative Examples 29-31 correspond to ADC12.

To investigate the influence of the average DAS as well as the composition on mechanical properties, three types of castings A-C were produced from each alloy of Examples and Comparative Examples by the methods described below.

(A) Castings A

Uniform-thickness castings A each having a U-shaped cross section (width: 25 mm, length: 80 mm, height: 20 mm, and thickness: 3 mm) were produced from the Al—Mg—Si aluminum alloys of Examples 1-9, 12-22 and Comparative Examples 1-21, 28, 29, 32-34, 37, 40 and 41 by the following method. First, as starting materials for each alloy, pure Al, pure Mg, pure Si and necessary metal elements each having an industry grade were charged into a graphite crucible in the formulations shown in Tables 1-1 and 1-2, melted at 750-770° C. in the air, and degassed by argon gas bubbling to remove inclusions and hydrogen. Using a high-pressure die-casting machine having a die compression force of 350 tons and a plunger tip diameter of 60 mm, each alloy melt was cast at a die temperature of 150-300° C., a melt temperature of 700-740° C., and an injection speed of 2-3 m/s. Each of the resultant castings A was air-cooled, and used in an as-cast state for the measurement of mechanical properties.

(B) Castings B

Planar castings B (width: 100 mm, length: 200 mm, and thickness: 3 mm) were produced from the Al—Mg—Si aluminum alloys of Example 10 and Comparative Examples 22-24, 30, 35 and 38 under the same conditions as for the castings A.

(C) Castings C

Planar castings C (width: 100 mm, length: 200 mm, and thickness: 2 mm) were produced from the Al—Mg—Si aluminum alloys of Example 11 and Comparative Examples 25-27, 31, 36 and 39 under the same conditions as for the castings A.

A 4-mm-wide tensile test piece, both surfaces of which were as-cast, was cut out of each casting (not heat-treated), and subject to a tensile test at room temperature according to JIS-Z2241 to measure its 0.2% yield strength and fracture elongation. In the test pieces fractured by the tensile test, portions free from plastic deformation were measured with respect to the average DAS of a primary α phase in the structure, by means of the line of intersection method described in "Measurement of Dendrite Arm Spacing," (Journal of Japan Institute of Light Metals, Vol. 38, pp. 54-60, 1988). Specifically, 10 straight lines were drawn on each of optical photomicrographs (magnification: 400 times) of three arbitrary fields such that they crossed primary α phases, and DAS in each three field was determined by the following formula from the length of each straight line and the number of dendrite arms crossing each straight line, and averaged for three fields.

$$DAS=[L_1/(n_1-1)+L_2/(n_2-1)+\ldots L_{10}/(n_{10}-1)]/10,$$

wherein $L_1, L_2, \ldots L_{10}$ represent the lengths of straight lines, and $n_1, n_2, \ldots n_{10}$ represent the numbers of dendrite arms crossing each straight line.

Table 1-1 shows the test results of Examples 1-22, and Table 1-2 shows the test results of Comparative Examples 1-41.

TABLE 1-1

| | | Composition(1) (% by mass) | | | | | |
|---|---|---|---|---|---|---|---|
| No. | Castings | Mg(2) | Si | Mn(2) | Cr(3) | Cu(3) | Ti(4) |
| Example 1 | A | 4.06 | 3.13 | 0.78 | 0.20 | 0.21 | — |
| Example 2 | A | 4.09 | 4.47 | 0.71 | 0.20 | 0.20 | — |
| Example 3 | A | 5.96 | 3.18 | 0.79 | 0.21 | 0.21 | — |
| Example 4 | A | 5.91 | 4.41 | 0.74 | 0.21 | 0.20 | — |
| Example 5 | A | 5.21 | 4.20 | 0.91 | 0.22 | 0.22 | — |
| Example 6 | A | 4.09 | 3.14 | 0.59 | 0.16 | 0.11 | — |
| Example 7 | A | 5.93 | 4.47 | 1.00 | 0.30 | 0.40 | — |
| Example 8 | A | 5.92 | 4.42 | 0.99 | 0.11 | 0.39 | — |
| Example 9 | A | 5.93 | 4.41 | 0.95 | 0.30 | 0.11 | — |
| Example 10 | B | 5.17 | 4.17 | 0.81 | 0.21 | 0.22 | — |
| Example 11 | C | 5.19 | 4.13 | 0.85 | 0.21 | 0.21 | — |
| Example 12 | A | 5.21 | 4.20 | 0.92 | 0.22 | 0.21 | 0.05 |
| Example 13 | A | 5.21 | 4.20 | 0.90 | 0.21 | 0.22 | 0.10 |
| Example 14 | A | 5.20 | 4.19 | 0.91 | 0.22 | 0.20 | 0.15 |
| Example 15 | A | 5.20 | 4.20 | 0.90 | 0.22 | 0.21 | 0.21 |
| Example 16 | A | 5.19 | 4.19 | 0.91 | 0.20 | 0.22 | 0.29 |
| Example 17 | A | 5.49 | 3.21 | 0.72 | 0.20 | 0.22 | — |
| Example 18 | A | 5.51 | 3.49 | 0.73 | 0.21 | 0.21 | — |
| Example 19 | A | 5.50 | 4.01 | 0.71 | 0.20 | 0.21 | — |
| Example 20 | A | 5.48 | 4.48 | 0.75 | 0.22 | 0.20 | — |
| Example 21 | A | 4.05 | 3.13 | 0.72 | 0.11 | 0.10 | — |
| Example 22 | A | 5.75 | 4.02 | 0.73 | 0.29 | 0.31 | — |

| No. | Average DAS (μm) | 0.2% Yield Strength (MPa) | Fracture Elongation (%) |
|---|---|---|---|
| Example 1 | 7.1 | 229 | 4.6 |
| Example 2 | 7.1 | 237 | 4.2 |
| Example 3 | 7.1 | 232 | 3.6 |
| Example 4 | 6.7 | 242 | 3.1 |
| Example 5 | 6.9 | 227 | 4.0 |
| Example 6 | 7.0 | 224 | 5.6 |
| Example 7 | 6.7 | 267 | 3.7 |
| Example 8 | 7.1 | 225 | 4.2 |
| Example 9 | 6.8 | 230 | 3.9 |
| Example 10 | 5.1 | 268 | 4.9 |
| Example 11 | 3.9 | 317 | 5.2 |
| Example 12 | 6.7 | 234 | 4.2 |
| Example 13 | 6.6 | 232 | 4.4 |
| Example 14 | 6.4 | 230 | 4.6 |
| Example 15 | 6.5 | 229 | 4.5 |
| Example 16 | 6.4 | 233 | 4.2 |
| Example 17 | 6.9 | 223 | 4.8 |
| Example 18 | 7.1 | 242 | 4.6 |
| Example 19 | 7.0 | 245 | 4.5 |
| Example 20 | 6.8 | 250 | 4.2 |
| Example 21 | 6.9 | 222 | 5.1 |
| Example 22 | 7.0 | 258 | 4.1 |

TABLE 1-2

| No. | Castings | Composition[1] (% by mass) Mg[2] | Si | Mn[2] | Cr[3] | Cu[3] | Ti[4] |
|---|---|---|---|---|---|---|---|
| Com. Ex. 1 | A | 3.81 | 3.17 | 0.74 | 0.21 | 0.20 | — |
| Com. Ex. 2 | A | 3.89 | 4.46 | 0.71 | 0.20 | 0.21 | — |
| Com. Ex. 3 | A | 6.25 | 3.13 | 0.76 | 0.21 | 0.21 | — |
| Com. Ex. 4 | A | 6.23 | 4.41 | 0.78 | 0.21 | 0.21 | — |
| Com. Ex. 5 | A | 4.03 | 3.06 | 0.74 | 0.21 | 0.20 | — |
| Com. Ex. 6 | A | 5.95 | 2.93 | 0.72 | 0.20 | 0.21 | — |
| Com. Ex. 7 | A | 4.07 | 4.75 | 0.73 | 0.21 | 0.20 | — |
| Com. Ex. 8 | A | 5.94 | 4.71 | 0.72 | 0.21 | 0.21 | — |
| Com. Ex. 9 | A | 4.02 | 3.19 | 0.42 | 0.11 | 0.11 | — |
| Com. Ex. 10 | A | 5.97 | 4.45 | 1.14 | 0.21 | 0.21 | — |
| Com. Ex. 11 | A | 5.93 | 4.50 | 0.90 | 0.08 | 0.40 | — |
| Com. Ex. 12 | A | 5.99 | 4.41 | 0.95 | 0.36 | 0.39 | — |
| Com. Ex. 13 | A | 5.96 | 4.45 | 0.95 | 0.29 | 0.08 | — |
| Com. Ex. 14 | A | 5.98 | 4.42 | 0.98 | 0.29 | 0.46 | — |
| Com. Ex. 15 | A | 5.90 | 4.45 | 0.98 | 0.29 | — | — |
| Com. Ex. 16 | A | 5.97 | 4.44 | 0.93 | 0.36 | — | — |
| Com. Ex. 17 | A | 5.95 | 4.47 | 0.96 | — | 0.39 | — |
| Com. Ex. 18 | A | 5.96 | 4.44 | 0.95 | — | 0.46 | — |
| Com. Ex. 19 | A | 5.20 | 4.16 | 0.85 | — | — | — |
| Com. Ex. 20 | A | 5.16 | 4.11 | 0.82 | 0.28 | — | — |
| Com. Ex. 21 | A | 5.14 | 4.16 | 0.85 | — | 0.39 | — |
| Com. Ex. 22 | B | 5.14 | 4.08 | 0.84 | — | — | — |
| Com. Ex. 23 | B | 5.19 | 4.12 | 0.86 | 0.29 | — | — |
| Com. Ex. 24 | B | 5.10 | 4.12 | 0.90 | — | 0.38 | — |
| Com. Ex. 25 | C | 5.26 | 4.17 | 0.89 | — | — | — |
| Com. Ex. 26 | C | 5.05 | 4.08 | 0.86 | 0.29 | — | — |
| Com. Ex. 27 | C | 5.06 | 4.21 | 0.83 | — | 0.38 | — |
| Com. Ex. 28 | A | 5.19 | 4.19 | 0.90 | 0.21 | 0.20 | 0.48 |
| Com. Ex. 29 | A | — | 11.04 | — | — | 2.51 | — |
| Com. Ex. 30 | B | — | 10.96 | — | — | 2.47 | — |
| Com. Ex. 31 | C | — | 11.23 | — | — | 2.49 | — |
| Com. Ex. 32 | A | 5.51 | 3.05 | 0.76 | 0.21 | 0.22 | — |
| Com. Ex. 33 | A | 5.52 | 4.65 | 0.70 | 0.20 | 0.20 | — |
| Com. Ex. 34 | A | 5.21 | 4.22 | 0.92 | 0.23 | — | — |
| Com. Ex. 35 | B | 5.16 | 4.10 | 0.85 | 0.20 | — | — |
| Com. Ex. 36 | C | 5.25 | 4.18 | 0.88 | 0.21 | — | — |
| Com. Ex. 37 | A | 5.20 | 4.22 | 0.92 | — | 0.21 | — |
| Com. Ex. 38 | B | 5.15 | 4.09 | 0.84 | — | 0.22 | — |
| Com. Ex. 39 | C | 5.24 | 4.17 | 0.89 | — | 0.20 | — |
| Com. Ex. 40 | A | 5.95 | 4.48 | 0.93 | 0.08 | 0.09 | — |
| Com. Ex. 41 | A | 4.53 | 3.12 | 1.00 | 0.04 | 0.11 | — |

| No. | Average DAS (μm) | 0.2% Yield Strength (MPa) | Fracture Elongation (%) |
|---|---|---|---|
| Com. Ex. 1 | 6.8 | 194 | 4.8 |
| Com. Ex. 2 | 6.9 | 214 | 4.0 |
| Com. Ex. 3 | 7.0 | 247 | 2.1 |
| Com. Ex. 4 | 6.9 | 256 | 1.4 |
| Com. Ex. 5 | 7.1 | 210 | 4.9 |
| Com. Ex. 6 | 6.7 | 214 | 4.2 |
| Com. Ex. 7 | 6.8 | 240 | 2.1 |
| Com. Ex. 8 | 6.8 | 247 | 1.7 |
| Com. Ex. 9 | 6.9 | 213 | 5.7 |
| Com. Ex. 10 | 7.0 | 270 | 1.3 |
| Com. Ex. 11 | 6.8 | 212 | 4.4 |
| Com. Ex. 12 | 7.0 | 274 | 1.4 |
| Com. Ex. 13 | 6.8 | 214 | 4.3 |
| Com. Ex. 14 | 7.0 | 269 | 2.7 |
| Com. Ex. 15 | 6.8 | 199 | 4.5 |
| Com. Ex. 16 | 6.9 | 213 | 2.3 |
| Com. Ex. 17 | 6.8 | 199 | 3.5 |
| Com. Ex. 18 | 7.1 | 207 | 4.2 |
| Com. Ex. 19 | 7.1 | 176 | 4.6 |
| Com. Ex. 20 | 6.9 | 197 | 3.4 |
| Com. Ex. 21 | 7.0 | 195 | 3.5 |
| Com. Ex. 22 | 5.0 | 207 | 4.8 |
| Com. Ex. 23 | 5.0 | 227 | 4.0 |
| Com. Ex. 24 | 4.9 | 237 | 5.4 |
| Com. Ex. 25 | 4.0 | 257 | 5.2 |
| Com. Ex. 26 | 3.9 | 280 | 4.5 |
| Com. Ex. 27 | 3.9 | 275 | 5.2 |
| Com. Ex. 28 | 6.5 | 241 | 2.8 |
| Com. Ex. 29 | 6.9 | 139 | 2.9 |
| Com. Ex. 30 | 4.9 | 157 | 3.7 |
| Com. Ex. 31 | 3.8 | 175 | 4.4 |
| Com. Ex. 32 | 6.7 | 215 | 4.5 |
| Com. Ex. 33 | 6.9 | 254 | 1.8 |
| Com. Ex. 34 | 6.9 | 188 | 4.3 |
| Com. Ex. 35 | 5.1 | 218 | 4.6 |
| Com. Ex. 36 | 4.1 | 259 | 5.0 |
| Com. Ex. 37 | 7.1 | 194 | 4.5 |
| Com. Ex. 38 | 5.2 | 231 | 5.6 |
| Com. Ex. 39 | 4.0 | 270 | 5.7 |
| Com. Ex. 40 | 6.8 | 209 | 4.9 |
| Com. Ex. 41 | 6.7 | 198 | 5.6 |

Note:
[1]The balance are Al and inevitable impurities.
[2]"—" in the columns of Mg and Mn means that their amounts as inevitable impurities were less than 0.3% by mass.
[3]"—" in the columns of Cr and Cu means that their amounts as inevitable impurities were less than 0.03% by mass.
[4]"—" in the column of Ti means that its amount as an inevitable impurity was less than 0.05% by mass.

Evaluation of castings A

As is clear from Table 1-1, any of Examples 1-9 and 12-22 had yield strength of 220 MPa or more and elongation of 3% or more. On the other hand, the yield strength of Comparative Examples 1 and 2 containing less than 4.0% of Mg was less than 220 MPa. Particularly, the yield strength of Comparative Example 29 (corresponding to ADC12), whose Mg content was on the impurity level (less than 0.3% by mass), was as low as 139 MPa. The yield strength of Comparative Examples 5, 6, 9, 11, 13, 32, 40 and 41, in which the amount of at least one alloy element was less than the lower limit of the present invention, was also less than 220 MPa. Further, Comparative Examples 3, 4, 7, 8, 10, 12, 14 and 28, in which the amount of at least one alloy element was more than the upper limit of the present invention, had elongation of less than 3% despite yield strength of 220 MPa or more.

Among Comparative Examples, in which the amounts of Mg, Si and Mn were near the upper limits of the present invention, both Comparative Examples 15 and 16 containing no Cu and Comparative Examples 17 and 18 containing no Cr had yield strength of less than 220 MPa. Among Comparative Examples 19-21, in which the amounts of Mg, Si and Mn were near the center values of the range of the present invention, Comparative Example 19 containing neither Cr nor Cu had yield strength of 176 MPa, but Comparative Example 20 containing only Cr near the upper limit had yield strength of 197 MPa, higher than Comparative Example 19 by 21 MPa. Comparative Example 21 containing only Cu near the upper limit had yield strength of 195 MPa, higher than Comparative Example 19 by 19 MPa.

The yield strength of Examples 5, 6 and 7 was 227 MPa, 224 MPa and 267 MPa, respectively, higher than that of Comparative Example 19 by 51 MPa, 48 MPa and 91 MPa, respectively. The increase of yield strength by adding Cr or Cu alone was about 20 MPa, and the increase of yield strength in Examples 5, 6 and 7 was as large as two times or more. The above results reveal that the aluminum alloys of the present invention containing both Cr and Cu had much larger yield strength than that of the aluminum alloys of Comparative Examples not containing either Cr or Cu.

Turning to Example 5, in which the amounts of Mg, Si and Mn were almost centers of the ranges of the present invention and Ti was contained only on the impurity level (less than 0.05% by mass), Examples 12-16 and Comparative Example 28 containing Ti, any of Examples 12-16 containing Ti had smaller average DAS values and higher yield strength and elongation than those of Example 5 containing no Ti. Comparative Example 28 containing Ti more than the upper limit of the present invention had elongation of 2.8%, less than 3%, despite yield strength of 220 MPa or more.

Evaluation of Castings A, B and C

The castings A, B and C of Examples 5, 10 and 11 having substantially the same compositions had different average DAS values of about 7 μm, about 5 μm and about 4 μm, respectively. This is due to the fact that shape differences of castings provided different cooling rates in solidification, resulting in different sizes of primary dendrites. It is generally known that aluminum alloys have higher yield strength as their primary dendrites become smaller. In the present invention, too, the castings C having the smallest primary dendrites had yield strength of 317 MPa, and the castings B having the second smallest primary dendrites had yield strength of 268 MPa.

Similarly, among Comparative Examples 19, 22, 25 having substantially the same compositions, the casting A (Comparative Example 19) had as low yield strength as 176 MPa, while the casting C (Comparative Example 25) had yield strength of 257 MPa and elongation of 5.2%. Thus, fine primary dendrites are formed in castings having easy-to-cool shapes, resulting in high yield strength and elongation, while high yield strength and elongation cannot be stably obtained in castings having shapes and sizes difficult to achieve high cooling rates.

The above results revealed that (a) by optimizing the amounts of Mg, Si and Mn and containing proper amounts of Cr and Cu, Al—Mg—Si-based, casting aluminum alloys with high yield strength as well as enough elongation can be obtained, (b) by adding a proper amount of Ti, the yield strength and elongation can be further improved, and (c) the addition of both Cr and Cu can provide improved yield strength to even cast members having shapes and sizes difficult to form small primary dendrites.

EFFECTS OF THE INVENTION

Because the Al—Mg—Si-based, casting aluminum alloys of the present invention have sufficient elongation and high yield strength even in an as-cast state, thin cast members made thereof have enough strength resistant to plastic deformation, achieving weight reduction. In addition, because the cast members of the present invention do not need a heat treatment, they can be produced at a low cost.

What is claimed is:

1. A cast member made of an Al—Mg—Si-based, casting aluminum alloy having large elongation and high yield strength comprising by mass, 4-6% of Mg, 3.1-4.5% of Si, 0.5-1% of Mn, 0.1-0.3% of Cr, and 0.1-0.4% of Cu, the balance being Al and inevitable impurities, wherein the total amount of Cr and Cu is 0.2-0.7%, and wherein said elongation and said yield strength are respectively 3% or more and 220 MPa or more in an as-cast state.

2. The cast member made of the Al—Mg—Si-based, casting aluminum alloy according to claim 1, further comprising 0.05-0.3% by mass of Ti.

3. The cast member made of an Al—Mg—Si-based, casting aluminum alloy according to claim 1, wherein the Mn content is 0.7-1.0% by mass.

4. The cast member made of an Al—Mg—Si-based, casting aluminum alloy according to claim 1, wherein said cast member is not subjected to a heat treatment.

5. A cast member made of an Al—Mg—Si-based, casting aluminum alloy having large elongation and high yield strength consisting of by mass, 4-6% of Mg, 3.1-4.5% of Si, 0.5-1% of Mn, 0.1-0.3% of Cr, and 0.1-0.4% of Cu, the balance being Al and inevitable impurities, wherein the total amount of Cr and Cu is 0.2-0.7%, and wherein said elongation and said yield strength are respectively 3% or more and 220 MPa or more in an as-cast state.

6. The cast member made of an Al—Mg—Si-based, casting aluminum alloy according to claim 5, wherein the Mn content is 0.7-1.0% by mass.

7. The cast member made of an Al—Mg—Si-based, casting aluminum alloy according to claim 5, wherein said cast member is not subjected to a heat treatment.

8. A cast member made of an Al—Mg—Si-based casting aluminum alloy having large elongation and high yield strength consisting of by mass, 4-6% of Mg, 3.1-4 5% of Si, 0.5-1% of Mn, 0.1-0.3% of Cr, 0.1-0.4% of Cu, and 0.05-0.3% of Ti, the balance being Al and inevitable impurities, wherein the total amount of Cr and Cu is 0.2-0.7%, and wherein said elongation and said yield strength are respectively 3% or more and 220 MPa or more in an as-cast state.

9. The cast member made of an Al—Mg—Si-based, casting aluminum alloy according to claim 8, wherein the Mn content is 0.7-1.0% by mass.

10. The cast member made of an Al—Mg—Si-based, casting aluminum alloy according to claim 8, wherein said cast member is not subjected to a heat treatment.

* * * * *